US006408691B1

(12) United States Patent
Sorben

(10) Patent No.: US 6,408,691 B1
(45) Date of Patent: Jun. 25, 2002

(54) WELL MONITORING SYSTEM

(76) Inventor: Donald R. Sorben, 10351 Matador Ct., San Diego, CA (US) 92124

( * ) Notice: Subject to any disclaimer, the term of this patent is extended or adjusted under 35 U.S.C. 154(b) by 11 days.

(21) Appl. No.: 09/723,052

(22) Filed: Nov. 27, 2000

(51) Int. Cl.[7] ..... E21B 43/00; E21B 49/10; E21B 43/12

(52) U.S. Cl. ..... 73/152.23; 73/152.28; 73/152.55; 166/250.03; 166/264

(58) Field of Search ..... 73/152.23, 152.28, 73/152.08, 152.55, 64.56, 864.14, 864.31; 166/250.03, 264, 372

(56) References Cited

U.S. PATENT DOCUMENTS 4,625,801 A * 12/1986 McLaughlin et al. ..... 166/267
4,669,554 A * 6/1987 Cordry ..... 175/59
4,717,473 A * 1/1988 Burge et al. ..... 210/170
5,228,345 A * 7/1993 Vales ..... 73/864.31
5,375,478 A * 12/1994 Bernhardt ..... 73/864.17
5,488,993 A * 2/1996 Hershberger ..... 166/372
6,092,416 A * 7/2000 Halford et al. ..... 73/152.23
6,138,750 A * 10/2000 Ford ..... 166/53
6,164,127 A * 12/2000 Izbicki et al. ..... 73/152.23

* cited by examiner

*Primary Examiner*—Hezron Williams
*Assistant Examiner*—David J. Wiggins
(74) *Attorney, Agent, or Firm*—Donn K. Harms

(57) ABSTRACT

A well monitoring apparatus for burial in the ground to sample and monitor subsurface water having a cylindrical bailer unit with an internal reservoir chamber for collection of samples communicated thereto from outside the bailer. A pressurization system allows for selected pressurization of the chamber from a remote location to transmit fluid therform to a remote location for inspection. The bailer may be buried separately or attached to the lower end of a conventional well casing.

12 Claims, 6 Drawing Sheets

WELL MONITORING SYSTEM

FIELD OF THE INVENTION

This invention relates to a device used to sample and monitor subsurface ground water. More particularly it relates to a device for taking samples from ground water adjacent to a drilled well and communicating those samples to the surface for analyzation. The procedures involved in subsurface ground water monitoring wells and the equipment require subsurface water samples to be used to perform the required precise tasks of chemical testing of those samples. The four primary procedures are bailing or purging water from the well, collecting ground water samples for testing, measuring the depth of the water, and performing hydraulic conductivity tests. An additional test would be a discrete sampling of the water at specific depth zones within the underground water table. These are all common tests required often in areas where there is a potential chance of the contamination of the natural aquifer.

BACKGROUND OF THE INVENTION

This device as herein disclosed features a new and unique Pneumatic Bailer device and process that will replace the expensive equipment and time-consuming procedures in the tasks involved with ground water monitoring wells. Ground water passing through the screen cuts in the well casings is presently raised by using an expensive stainless steel submersible electric pump lowered into the well casing on a suspension cable along with a power cable and discharge/sampling hose. The so described procedures are accomplished and the pump is returned to the surface where it must be decontaminated before being used again. This decontamination process entails washing the inside and outside of all the equipment used with a solution of TSP (Tri-Sodium Phosphate) and then rinsing twice with deionized or distilled water to produce an accurate sampling thereafter. Often a generator is required to supply power for the submersible pump when used in remote locations. With this equipment, access to the inlet of the well casing is always required and the successful operation of equipment on wells that have been drilled on an angle to get beneath an existing obstacle is sometimes hampered.

U.S. Pat. No. 3,075,585 of L. A. Carlton ET AL describes an invention related to fluid samples, and more particularly to apparatus for taking samples of fluids at remote locations such as in a deep well in the earth. This invention relates to a device to be lowered down into wells to take a small sample in a controlled environment, and therein transport it to the surface. This invention has no means to pump water or any other fluid to the surface as in the so disclosed Bailer Unit.

U.S. Pat. No. 3,296,971 of A. L. Nielson discloses a mounting means for a sub floor pump. This device as disclosed teaches of a sub-floor, or basement pump to elevate water from the premises, not for lifting a fluid from a monitoring well which may be just below the surface or go as deep as 250 feet.

SUMMARY OF THE INVENTION

The outstanding convenience and economy of the device herein disclosed is made evident in the description of the well sampling and testing device or Pneumatic Bailer Unit used to perform the tasks required in well monitoring, without the time consuming decontamination process. The sophisticated, expensive equipment requires a great deal of time to decontaminate prior to being used for testing at another well monitoring site. These and other additional benefits will be elaborated upon further in this disclosure.

The preferred embodiment of the simplest version of this invention is where a hermetically sealed bailer unit is placed remotely below the surface in a bore-hole surrounded by a sand filter casing with a discharge or sampling pipe along with a pneumatic line going to the surface monitoring stations. The material that the Bailer Unit and the parts therein are constructed of, is most commonly PVC (Poly Vinyl Chloride) similar to that used on well casing stock, although in some cases the unit can be constructed of other rust resistant material like stainless steel and maintain the same disclosed configuration. A pipe translates through a sealed orifice in the wall surface at the top of the Bailer Unit, down through the unit to the lower distal end thereupon attached to a one-way valve opening in a close proximity to the bottom of the Bailer Unit and allowing the discharge of the water to the surface monitoring station. The pneumatic pressure/vacuum line enters the Bailer in the upper side wall of the unit. All penetrations and connections into the Bailer Unit maintain the hermetic sealing required by, but not limited to, the process of plastic welding or gluing. The surface monitoring station consists of a concrete vault with connectors to the discharge and pneumatic lines and a lockable cover plate. These sites may be placed in areas where the opening at the top of the conventional well casings would be inaccessible, as in directly below fuel storage tanks, and below buildings or roadbeds. Even with the remote placement of these units, they can be decontaminated if required, by injecting a soap solution of TSP through the pneumatic line into the Bailer chamber and rinsing with distilled or de ionized water. After this procedure, the liquid can be blown out with air through the same pneumatic line, ejecting through the discharge/sampling pipe to the surface monitoring station.

An alternate embodiment has the same Bailer Unit cooperatively attached at the lower most, or the distal end of the well casing by a coupler unit. A single tubular member translates from within the well casing through the coupler and into the Bailer retaining the hermetic ceiling of the unit. This tube is then attached to a one-way valve in close proximity to the top of the Bailer Unit, restricting any back flow from the Bailer into the well casing. The pressure/vacuum line penetrates the upper side wall of the Bailer chamber as in the initial embodiment. A second tubular member will penetrate the side wall of the Bailer in close proximity to the bottom of the Bailer Unit, with a second one-way valve. The second valve restrains any flow back into the Bailer from the discharge or sampling pipe going to the surface. An additional pneumatic pressure line attaches through the coupler unit into the well casing reservoir. This additional pneumatic line is used to make water pressure readings and to stir any sediment collected in this area. The two separate pneumatic lines for gas or compressed air are attached near the union of the well casing coupler, and the Bailer through the walls of the well casing and Bailer respectively, connecting to the surface monitoring station by means of a pipe or tubing, described as pneumatic lines. This assembly remains permanently affixed to the bottom of the well casing assuring that no external contamination other than what might be in the ground water will be in the Bailer Unit.

With the application of compressed air or gas pressure through the line into the Bailer Unit, the water therein is forced out and up the discharge/sampling pipe to the surface. With a vacuum replacing the compressed air or gas, and the water pressure in the well casing, the water is drawn rapidly down into the Bailer Unit. Then with the re application of the air or gas pressure the Bailer chamber can be purged of the water and sediment collected within to the surface monitoring station. This process may be repeated several times to assure a fresh sample.

An additional alternate embodiment of the invention will have the Bailer Unit attached to the bottom of the well casing, with a separate reservoir cooperatively attached below. The lower reservoir will have the same screen configuration of the well casing material allowing water to enter freely. A pipe communicating between the two cavities with the first one-way valve being in the lower reservoir chamber, allowing water to move up only into the Bailer chamber, and the second one-way valve located in the Bailer allowing the water to be forced out to the surface monitoring station through the discharge/sampling pipe. A pressure line will enter into the top of the Bailer Unit with the additional pressure line entering the bottom of the well casing. Though the normal pressure will push the water up into the Bailer, the capability of the added vacuum will accelerate the sampling and purging process. This configuration will allow the well to operate independent of the Bailer Unit, so that a sample may be taken when the well is in operation.

An additional enhancement of the Bailer Unit will have a zone reducing tube lowered down into the well casing surface opening to perform discrete sampling of the water at specific zones within the water table. The zone reducing tube is comprised of a series of sections of PVC tubing and couplers reaching the full length of the well casing. A perforated PVC sampling section of tubing can be inserted at any level of the zone reducing assembly. At the lower end of the zone reducing tube is a centralizer, and a soft plastic ball with a hole through the center, affixed to the end of the PVC tubing. The soft rubber tube is attached on the pipe communicating between the well casing and the Bailer Unit. As the zone reducing tube is lowered into the well casing, the centralizer locates the soft ball over the rubber tube to create an adequate seal for the sampling of the specific zone in the water table. The centralizer, consists of a PVC circular device, smaller in diameter than the inside of the well casing with orifices allowing the water to pass through. The centralizer is attached to the PVC tubing just above the ball, so that when the zone reducing tube is lowered it will locate the ball over the top of the tube on the sample inlet valve.

All of the embodiments of the Bailer Unit would be coupled with a Well Monitoring Control Panel Console. The console has an intake port to be coupled with a compressed air source means, such as an air compressor or air tank, or compressed gas tank of inert gas such as nitrogen. It is possible that even a small battery operated air compressor might be used to accomplish the tasks adequately. Compressed air from the atmosphere is generally used to purge water from the device and to create a vacuum, because of its lower cost. Use of compressed gas would be preferred in cases where ground water samples are being collected which require extreme accuracy as to contents, due to its inert chemical properties.

A 4-way valve allows the operator to switch from off, to pressure or vacuum, until the desired amount of ground water is removed. An optional on/off valve on the pressure/vacuum line offers a redundancy in the closing of the line for testing purposes. The pressure regulator on the pressure/vacuum line allows for the control of the pressure used to perform the required procedures. A sensitive pressure/vacuum gauge will give the operator the information needed to determine the depth to ground water by measuring the pressure needed to raise ground water in the discharge tube just to the surface, and converting this pressure reading into an equivalent height of water. A three-way valve is incorporated at the discharge end of the pressure/vacuum line to allow pressure to be switched from the Bailer Unit line, to the well casing coupler line, for determining the ground water pressure reading, and stirring the accumulated sediment in the bottom of the well casing. A secondary vacuum line on-off valve is incorporated before the venturi unit to assure of a redundancy in the sealing means on the vacuum line. The vacuum is used to accelerate the entry of the water into the Bailer chamber. Hydraulic conductivity of the aquifer adjacent to the well can be estimated by performing a "slug test" with the Bailer Unit system, and using one of several methods of calculation. The procedure consists of rapidly changing the height of water in the well by removing one or more Bailer volumes of ground water from the well, then periodically, recording the pressure indicated on the pressure gauge as the well returns to an equilibrium. The incremental pressure readings can then be converted into the height of water in the well, at a given time. The variation of height of water, over time, is used in the "slug test" calculations. The system is presently configured to measure ground water height equivalent to ¼ inch (0.01 psi).

It is the object of this invention to create a device that in the simplest form can be located in wells inaccessible areas with a remote monitoring capability.

It is another object of this invention to create an inexpensive device that may stay at the site location, and not require the continuous time-consuming decontamination of a single pumping system.

It is still another object of this invention to create a device that can operate located beneath a monitoring well, sampling from within the well casing.

It is still another object of this invention to create a device that can be attached below a well casing, taking samples from a component reservoir without disturbing the operation of the well itself.

It is still another object of this invention to create a device that has the capability of taking samples from different zones within the water table being sampled by a well.

It is still another object of this invention to provide a control console to operate and record all the procedures and operations, required in well monitoring These together with other objects and advantages, which will become subsequently apparent, reside in the details of construction and operation as more fully described and claimed, reference being had to the accompanying drawings forming a part hereof, wherein like numbers refer to like parts throughout.

BRIEF DESCRIPTION OF THE DRAWING FIGURES

The accompanying drawings, which are incorporated in and form a part of this specification, illustrate preferred embodiments of the disclosed device and together with the description, serve to explain the principles of the invention.

DETAILED DESCRIPTION OF PREFERRED EMBODIMENTS

Figures 1, 2, 3:
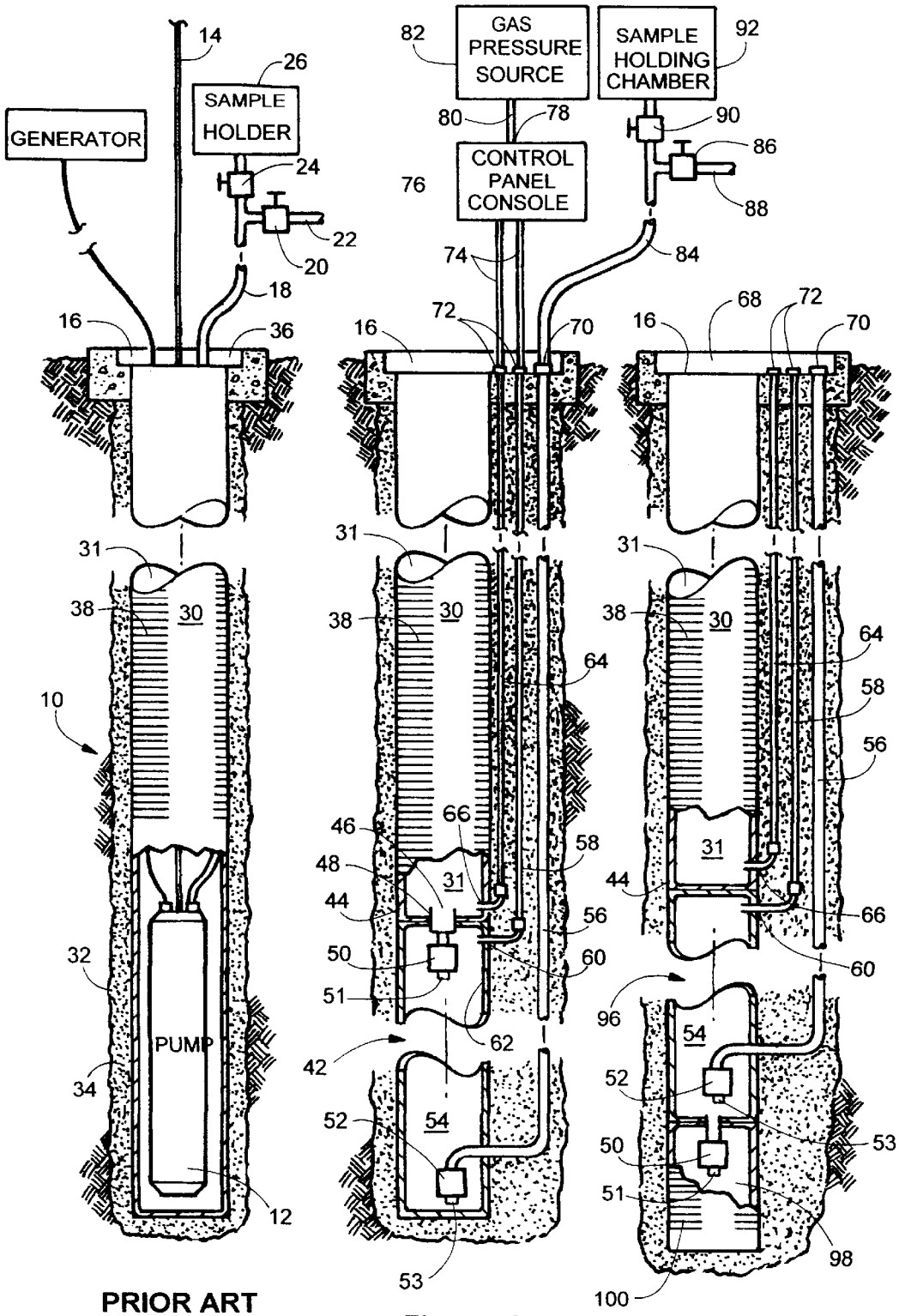
PRIOR ART Figure 1
FIG. 1 (Prior Art) is a section through a typical monitoring well casing showing the surface connections in diagram form and the submersible pump.
FIG. 2 is a section through a top draft Pneumatic Bailer Unit showing the surface monitoring station and the well monitoring control console in diagram form.
FIG. 3 is a section through a bottom draft Pneumatic Bailer Unit.

Referring now to FIG. 1 it depicts a section view of a typical present day monitoring well 10, with the prior art shown where a stainless steel submersible electric pump 12 is lowered by the means of a suspension line 14 down through the well casing inlet 16 to a bottom portion of the well 10. A discharge/sampling hose 18 communicates between a pump 12 and the surface, to be optionally directed though either a purge valve 20 to a purge discharge hose 22, or through a sample valve 24, to the sample holding chamber 26. If local electrical power is unavailable, an electric generator is generally used to provide power to the pump 12.

The common practice is to have the well casings 30 inserted into the bore hole 32, and then backfilled with sand, forming a sand filter casing 34 around the well casing 30. The well casing 30 conventionally consists of a plastic pipe such as Polyvinyl Chloride (PVC) pipe having a polarity of screen cuts 38 communicating through the wall surface and allowing filtered ground water into the internal well casing cavity 31. The well casing inlet 16 on the surface is generally enclosed in a lockable concrete vault 36 which houses the attachment ends to the various tubes at the ground surface.

FIG. 2 depicts an embodiment of the device herein disclosed showing a section through a top draft embodiment of the Pneumatic Bailer Unit 42, removably attached by a means of removable attachment to the distal end of a well casing 30 in the form of a coupler 44 to the distal end of the well casing 30. A pipe 46 in a sealed engagement with orifice 48 communicates liquid from the bottom end of well casing cavity 31 into the upper portion of the Bailer Unit 42 and through a one-way valve 50 situated inside of the bailer reservoir chamber 54 at the exit end of the pipe 46. This one way valve provides a means for one way communication of water from the well casing cavity 31 into the Bailer reservoir chamber 54 thus restricting any flow in the opposite direction. A second one-way valve 52 allows communication of the water collected in the Bailer reservoir chamber 54 to exit through exit orifice 53 under pressure and thereby communicate the exiting water out of the reservoir chamber 54 through the sample pipe 56 using a means to pressurize the reservoir chamber 54 which forces the water through the sample pipe 56 to an exit at its distal end.

During operation of the device gas pressure is injected into the Bailer chamber 54 by the aforementioned means of the pressurizing the bailer chamber 54 in this case illustrated as the pressurizing line 58 in sealed communication with the chamber 54 through the orifice 60 of the pressurizing line 58 located in the upper side wall 62 of the Bailer chamber 54. An additional pressure line 64 may be placed to enter the coupler 44, through orifice 66 into the lower interior of the well casing 30.

Figure 6:
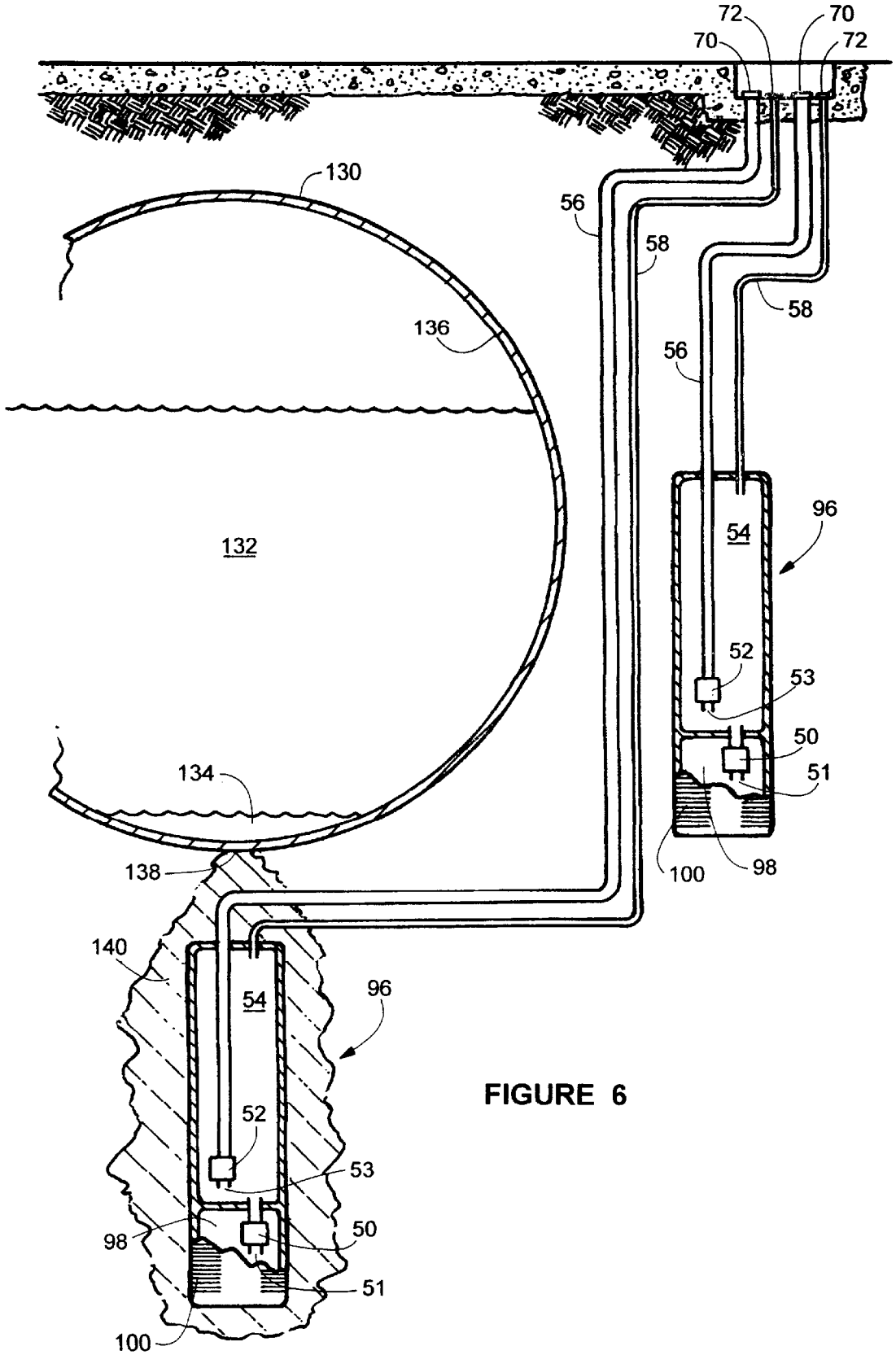
FIG. 6 is a section through an exemplar under ground fuel storage facility with two, bottom draft Pneumatic Bailers, and the remotely located surface monitoring station.

In the simplest mode of the device as depicted in FIG. 6, only the pressurizing line 58 and the discharge or sample pipe 56 would be required and the user could obtain samples of the water in the bailer reservoir chamber 54 by simply attaching a pressure generation means to the pressurizing line 58 which would cause water to exit the sample pipe 56 into the desired container. The water so exiting could then be analyzed on the site or at a remote site as needed. The mode of operation would thus only require that the device be placed in a properly sized and situated well and then surrounded by sand with both the pressurizing line 58 and sample pipe 56 exiting above ground for use.

In an embodiment of the device which allows more on site adjustment and utility, the pressurizing line 58 and the additional pressure line 64 and sample pipe 56 would generally extend to the surface and communicate with respective receiving pipes in a monitoring station 68. The lines so exiting the device to the surface would generally terminate in a lockable vault 36, with a hose coupler 70 for the sample pipe 56 and two pneumatic fittings 72 attached to the attachment ends of pressurizing lines 58 and 64. In this configuration, when well readings are to be taken, the operator will attach the two pneumatic lines 74 from the Well Monitoring Control Panel Console 76 to the pneumatic fittings 72 in the vault 36. The Well Monitoring Control Panel Console intake port 78 is connected by the means of the pneumatic line 80 to a means for pressurizing such as gas pressure source 82 from a group of pressurizing means including compressed gas or air cylinder, or an air compressor. The discharge or sampling hose 84 connects to hose coupler 70 on one end and optionally communicates with one or both of either purge valve 86 and hose 88, or sample valve 90 and sample holding chamber 92. Water from the well sample is thus placed in the holding chamber 92 on activation of the console 76 and stored for later sampling and analyzation.

FIG. 3 is a section through a bottom draft Bailer Unit 96 embodiment of the disclosed device, with a lower reservoir chamber 98 with a series of screen cuts 100, similar to those in the well casing 30. A One-way valve 50 allows water to pass from the lower reservoir 98 and communicate through exit orifice 51 into Bailer reservoir chamber 54 through the communicating pipe 46. The second one-way valve 52 located in the bailer reservoir chamber 54 allows the water to pass under pressure in the aforementioned fashion using air pressure to pressurized provided by pressurizing line 58 to pressurize the bailer reservoir chamber 54 and thereby force water therein through orifice 53 of the sample line 56 to an exit at the other end of the sample line 56. This embodiment allows the bailer to sample fluid collected at the bottom of the bailer 42 in the lower reservoir 98 instead of from the bottom of the well casing above the bailer 42. This embodiment works especially well when samples are desired from below the casing or when no casing is used as depicted in FIG. 6.

Figure 4:
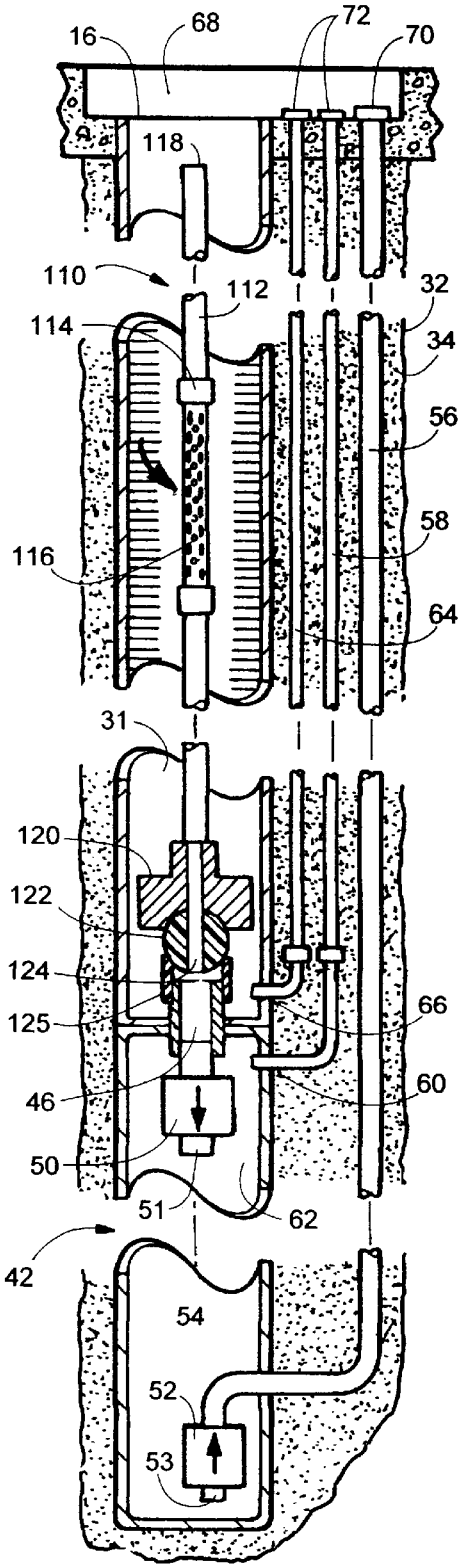
FIG. 4 is a section through a top draft Pneumatic Bailer Unit with the incorporation of the zone reducing tube.

FIG. 4 is a section through the top draft embodiment of Bailer Unit 42 with the adaptation of a means for selective sampling of a fluid from a determined level in the well casing which in the current best mode is depicted in the form of a zone reducing tube assembly 110. This tube assembly 110 consists of an arrangement of sections of conventional PVC pipes 112 and couplers 114, with one perforated sampling section 116 to be located at the desired level in the casing for a sampling zone to selectively sample a certain area of the well. The assembly 110 is open at the top end 118 with a centralizer 120, and a soft ball-shaped seal 122 having a seal passage 124, therethrough attached at the lowermost end of the assembly 110. The soft ball shaped seal 122 forms a seal with a soft section of hose 125 attached to pipe 46 in the Bailer Unit even at odd angles of engagement. Using this configuration for the assembly 110 the user may insert different assemblies with the sampling section 116 at different determined heights from the top of the well casing. To change the height that the sample is taken from the user would simply pull the assembly 110 out of the casing thereby disengaging the sealed engagement of the ball-shaped seal 122 with the hose 125. A newly configured assembly 110 can thereafter be reinserted and the ball-shaped seal 122 re engaged with the hose 125. The use of this ball shaped seal 122 allows for the ability to reconfigure the sampling apparatus as it is easily engaged with the hose 125 even when the hose 125 is covered by water. The ball-shaped seal 122 also provides an excellent sealing means when so engaged, even at angles other than 180 degrees.

Figure 5:
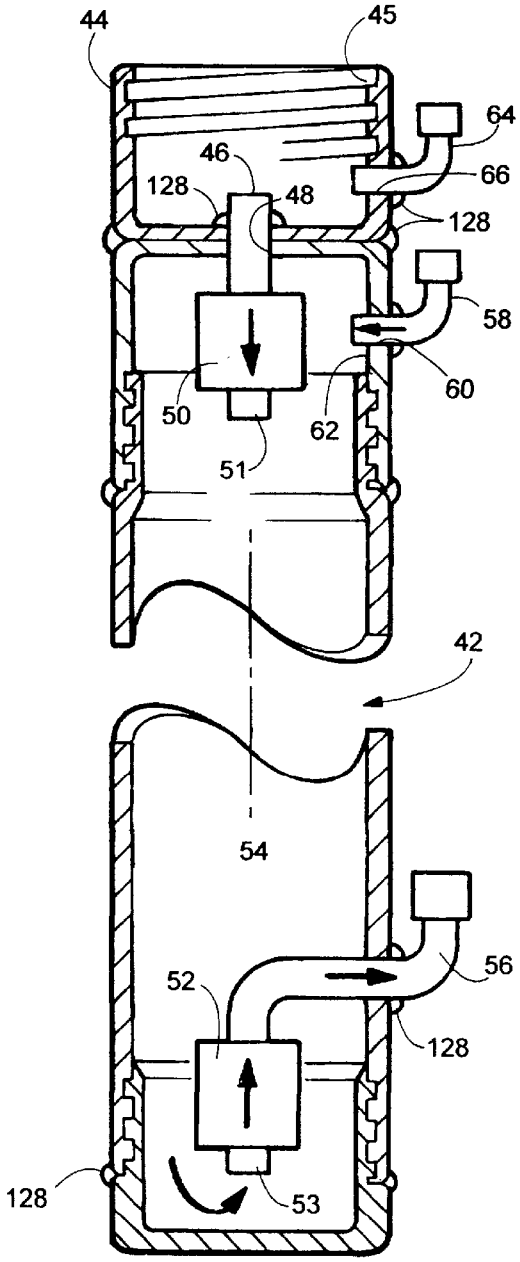
FIG. 5 is a section through a top draft bailer unit showing the valve location and the flow direction.

FIG. 5 is a section through a top draft Bailer Unit 42 showing the valve locations and flow direction, along with all the welds 128 on all connections and penetrations into the Bailer chamber 54. Of course those skilled in the art may have other manner of interconnecting the parts to yield a similar structure and such are anticipated. The device as depicted in FIG. 5 is in one of the simplest functional embodiments of the disclosed device for use in combination with a well casing. It features a means for removable attachment to a well casing in the form of coupler 44 on the upper end, and internal reservoir chamber 54 a pressurizing pipe 58, a sampling pipe 56 at the bottom end. A first one way valve 50 allows water in from collection in the casing above and a second one way valve 52 provides one way communication of water from the bailer reservoir chamber 54 through the sample pipe 56 when pressurized by the pressurizing line 58. It can easily be attached to the lower or distal end of a well casing inserted into drilled hole and be removed with the casing, or detached from the casing by rotating the casing to disengage the coupler threads 45 which cooperatively engage threads on the end of a casing.

FIG. 6 depicts an embodiment of the device that might be used without the need for the casing. It shows a section through a conventional underground fuel storage tank 130, showing the fuel 132 and where a potential penetration 138 may occur. A theoretical contamination 140 of the aquifer, is shown in close proximity to the simplest embodiment of the bottom draft Bailer Unit 96 with a second Bailer Unit shown in a typical positioning adjacent to the side of the storage tank 130. Both Bailer Units are connected to the surface monitoring station 68 by the means of the discharge or sample pipes 56, using pressure provided by the pressurizing line 58. This embodiment is especially useful for permanent or long term applications where well casings are not needed such as next to tanks, under roads, or in a similar manner.

Figure 7:
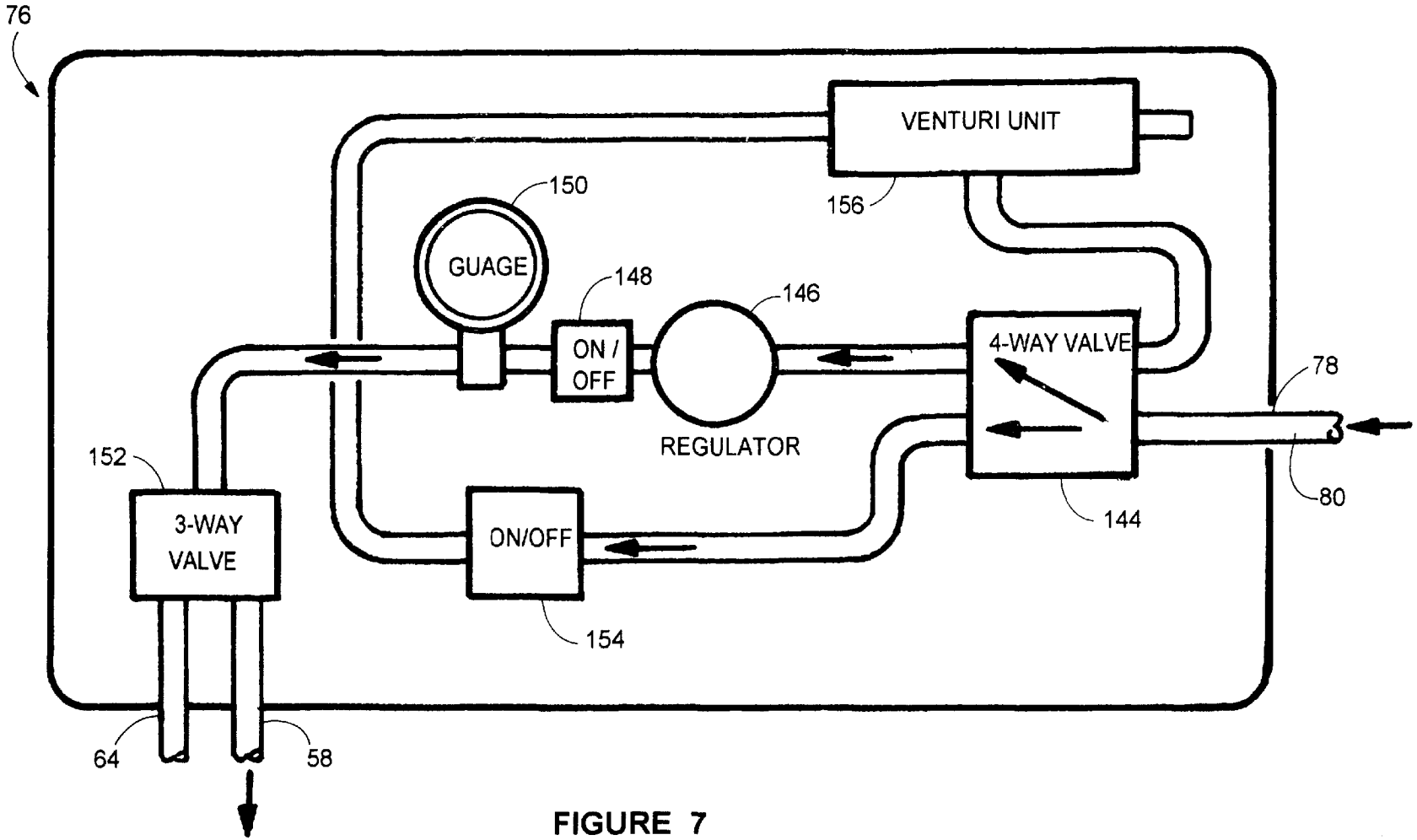
FIG. 7 is the Well Monitoring Control Panel Console showing the flow direction, in the Bailer pressurization mode.
Figure 8:
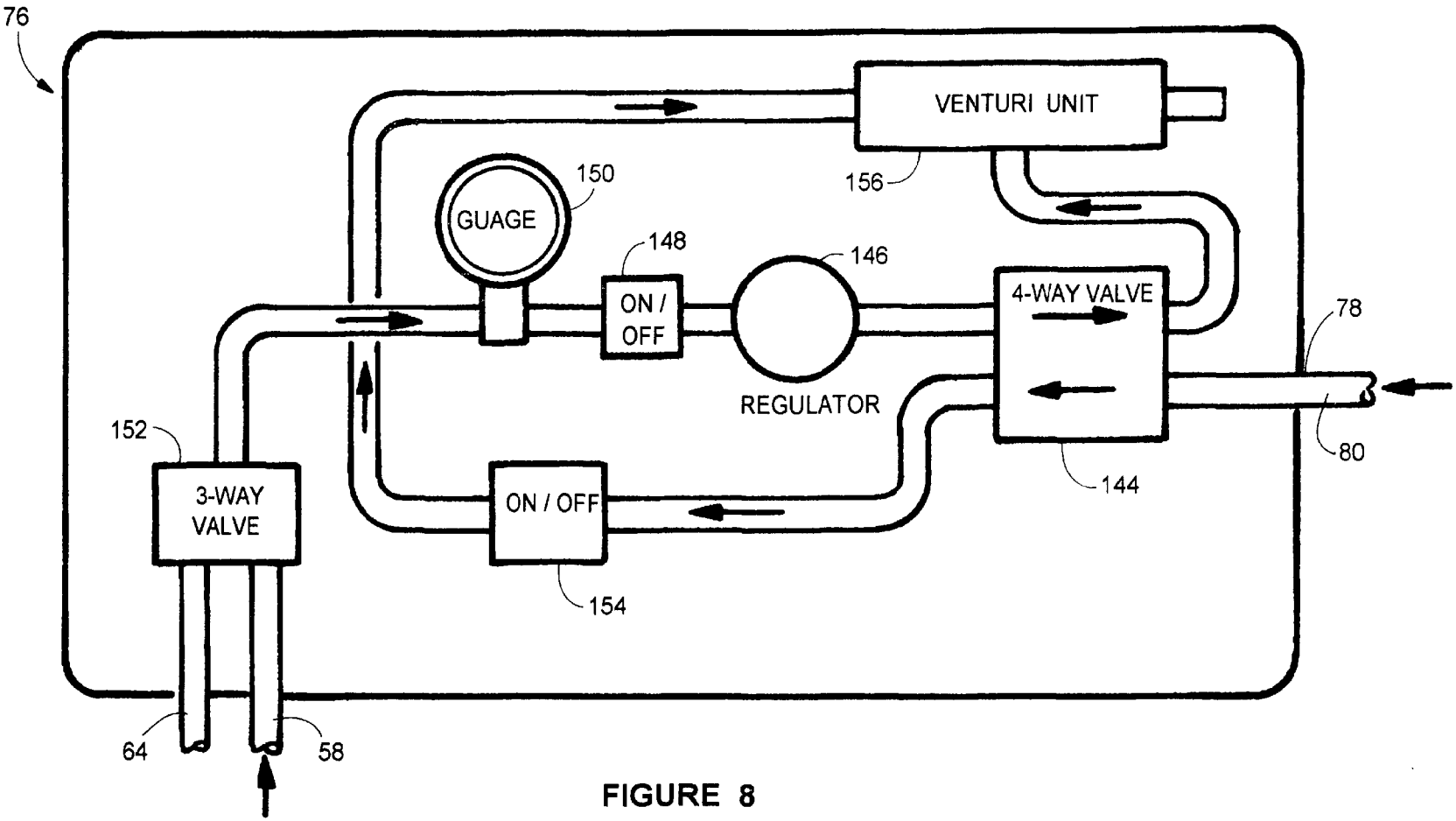
FIG. 8 is the Well Monitoring Control Panel Console showing the flow direction, in the Bailer vacuum mode.
Figure 9:
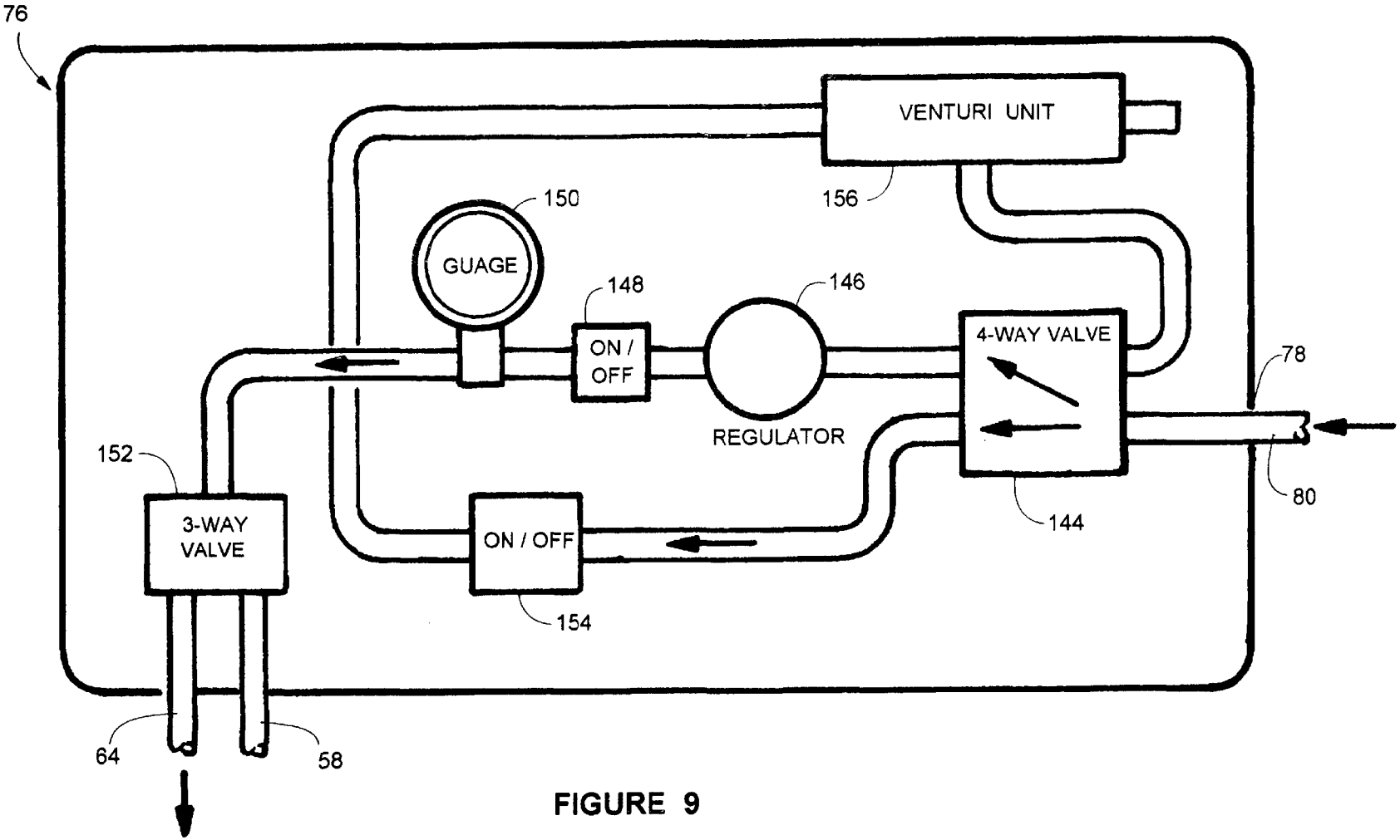
FIG. 9 is the Well Monitoring Control Panel Console showing the flow direction, in the well casing pressurization mode.

FIGS. 7, 8 and 9 are diagrams of the configurations of Well Monitoring Control Panel Console 76 with the pressure line 80 entering the intake port 78 into the unit. A 4-way manually actuated valve 144, makes the adjustment from the pressure mode to the vacuum mode and also to the closed position. In the pressure mode, the line is open to the pressure regulator 146 and an additional on-off valve 148, offering a redundancy for performing accurate testing. A sensitive pressure/vacuum gauge 150 is located on the pressure line prior to the 3-way control valve 152 making the adjustment between directing the pressurized air or gas, through the pressure line 64, to the well casing cavity 31, or to the pressurizing line 58 to the Bailer chamber 54. When the vacuum is desired the 4-way valve 144 is adjusted to direct the flow of air or gas through a secondary on-off valve 154 to a venturi unit 156, to create a vacuum directed back through the 4-way valve 144 into line pressurizing line 58.

While all of the fundamental characteristics and features of the Pneumatic Bailer have been shown and described herein, it should be understood that various substitutions, modifications and variations may be made by those skilled in the field, without departing from the spirit of scope of the invention. Consequently, all such modifications and variations are included within the scope of the invention as defined by the following claims.

What is claimed is:

1. A well monitoring apparatus for burial in the ground to sample and monitor subsurface water comprising:

a cylindrical bailer unit having a top end wall, a bottom end wall, and a side wall communicating with both of said top end wall and said bottom end wall;

a bailer reservoir chamber defined by the area between said top end wall, said bottom end wall and said sidewall;

an intake pipe, said intake pipe having an external end communicating with a fluid collection reservoir outside said bailer reservoir chamber, said intake pipe having an internal end located inside said bailer reservoir chamber, a passageway communicating through said pipe from said internal end to said external end;

means to prevent flow through said passageway from said internal end toward said external end thereby allowing only flow from said external end to said internal end;

a discharge pipe, said discharge pipe having an entry end located in a lower end of said bailer reservoir chamber, and having an exit end located at a collection point outside said bailer reserviour chamber;

a conduit communicating through said discharge pipe from said entry end to said exit end;

means to prevent flow through said conduit from said exit end toward said entry end thereby allowing only flow through said conduit from said entry end toward said exit end;

means of pressurizing said bailer reservoir chamber for a determined time period of pressurization, whereby fluid collected in said fluid collection reservoir and communicated through said intake pipe to said bailer reservoir chamber is forced through said conduit in said discharge pipe and thereafter discharging at a collection point at said exit end of said conduit, during said determined time period of pressurization.

2. The well monitoring apparatus as defined in claim 1 further comprising:

means for releasable attachment of said cylindrical bailer unit to the lower end of a well casing.

3. The well monitoring apparatus as defined in claim 1 wherein said means for pressurizing said bailer reserviour chamber is a compressed air source from a group of compressed air sources including a compressor and a pressurized air tank, said compressed air source communicating with said bailer reservoir chamber through a pressurizing hose.

4. The well monitoring apparatus as defined in claim 3 wherein said means to prevent flow through said conduit from said exit end toward said entry end thereby allowing only flow through said conduit from said entry end toward said exit end is a one way valve positioned to interrupt flow through said conduit; and said means to prevent flow through said passageway from said internal end toward said external end is a second one way valve positioned to interrupt flow through said passageway.

5. The well monitoring apparatus as defined in claim 4 further comprising:

means for releasable attachment of said cylindrical bailer unit to the lower end of a well casing.

6. The well monitoring apparatus as defined in claim 2 wherein said means for releasable attachment of said cylindrical bailer unit to the lower end of a well casing comprises:

a collar affixed at a first end to said top end wall of said cylindrical bailer unit, said collar having an open end opposite said first end, said collar having groves formed therein, said groves configured for cooperative rotational engagement with casing grooves located on said lower end of said well casing to be used in combination herewith.

7.The well monitoring apparatus as defined in claim 5 wherein said means for releasable attachment of said cylindrical bailer unit to the lower end of a well casing comprises:

a collar affixed at a first end to said top end wall of said cylindrical bailer unit, said collar having an open end opposite said first end, said collar having groves formed therein, said groves configured for cooperative rotational engagement with casing grooves located on said lower end of said well casing to be used in combination herewith.

8. The monitoring apparatus as defined in claim 2 further comprising a means to sample water from a determined area in said well casing when said cylindrical bailer unit is attached to the lower end of a well casing submerged in the ground.

9. The monitoring apparatus as defined in claim 8 wherein said intake pipe communicates through said top wall and has a flexible collar affixed to said external end, said flexible collar having a lower end, and having an upper end, and having an internal collar passageway communicating therebetween;

said collar in sealed communication at said lower end with said external end of said intake pipe;

an elongated sampling pipe having a pipe sidewall and having an axial passage therethrough communicating with an aperture at a bottom end of said elongated sampling pipe;

a sampling zone at a determined distance from said bottom end of said elongated sampling pipe, said sampling zone having at least one orifice communicating through said pipe sidewall to said axial passage; and a ball-shaped seal located about the exterior of said elongated pipe at said bottom end, said ball-shaped seal having a circumference slightly larger than the circumference of said internal collar passageway, whereby only water collecting in said well casing in said sampling zone and is therein communicated to said bailer reservoir chamber through said axial passage.

10. The monitoring apparatus as defined in claim 7 further comprising:

said monitoring apparatus connected to a casing used in combination herewith;

a pressurizing tube communicating through collar adjacent to said first end, said pressurizing tube having a monitor end external to said casing and an exhaust end located inside said collar and a passage communicating therebetween;

said pressurizing tube communicating pressurized air for determined periods to said well casing when attached to an air pressure means at said monitor end;

a well casing internal pressure monitor, said well casing internal pressure monitor provided by said pressurizing tube communicating air pressure levels inside said well casing to a pressure senor communicating with said monitor end when detached from said pressure means.

11. The monitoring apparatus as defined in claim 1 further comprising:

said external end of said intake pipe terminating at a connection point above ground when said cylindrical bailer unit is buried;

said exit end of said discharge pipe terminating at an above surface collection point above ground when said cylindrical bailer unit is buried, whereby samples of water collected in said bailer reservoir chamber are expelled from said discharge pipe for said defined period of time at said above surface collection point when said means of pressurizing said bailer reservoir chamber is connected to said connection point of said intake pipe and pressurized for said determined time period.

12. The monitoring apparatus as defined in claim 11 further comprising:

a control unit, said control unit having a valve attachable to said connection point of said intake pipe whereby control of pressure communicated thereto is varied by said valve said valve controllable manually or by a pressure regulator; and said collection point of said discharge pipe attached to an external collection reservoir.

* * * * *